US006342870B1

(12) United States Patent
Mehrkens et al.

(10) Patent No.: US 6,342,870 B1
(45) Date of Patent: Jan. 29, 2002

(54) ANTENNA FRAME STRUCTURE MOUNTING AND ALIGNMENT

(75) Inventors: Thomas K. Mehrkens, Bellevue; Steven R. Overton, Seattle, both of WA (US)

(73) Assignee: Harris Corporation, Melbourne, FL (US)

( * ) Notice: Subject to any disclaimer, the term of this patent is extended or adjusted under 35 U.S.C. 154(b) by 0 days.

(21) Appl. No.: 09/267,492

(22) Filed: Mar. 12, 1999

(51) Int. Cl.[7] ..... H01Q 1/12
(52) U.S. Cl. ..... 343/891; 343/890
(58) Field of Search ..... 343/890, 891, 343/872, 878, 879, 892, 882, 765, 893; 52/111, 121, 114, 300, 465

(56) References Cited

U.S. PATENT DOCUMENTS 5,867,132 A * 2/1999 Blasing et al. ..... 343/890
5,880,701 A * 3/1999 Bhame et al. ..... 343/890
5,969,693 A * 10/1999 Legg ..... 343/890

* cited by examiner

*Primary Examiner*—Don Wong
*Assistant Examiner*—Chuc D Tran
(74) *Attorney, Agent, or Firm*—Carter, Ledyard & Milburn

(57) ABSTRACT

A system and method for deploying antenna modules to provide communications within selected areas are disclosed. In the preferred embodiment a base structure is deployed which may be populated with a plurality of antenna modules providing directional communication. As demand for communication services increases, antenna modules may be added to the base structure. The base structure provides for the simplified installation and replacement of antenna modules. Additionally, the base structure provides adjustment in both the horizontal (azimuthal) and vertical (elevation) planes. Multiple ones of the base structure may be deployed in order to provide an enlarged communication area and/or to provide increased communication density within a particular communication area.

68 Claims, 6 Drawing Sheets

FIG. 1
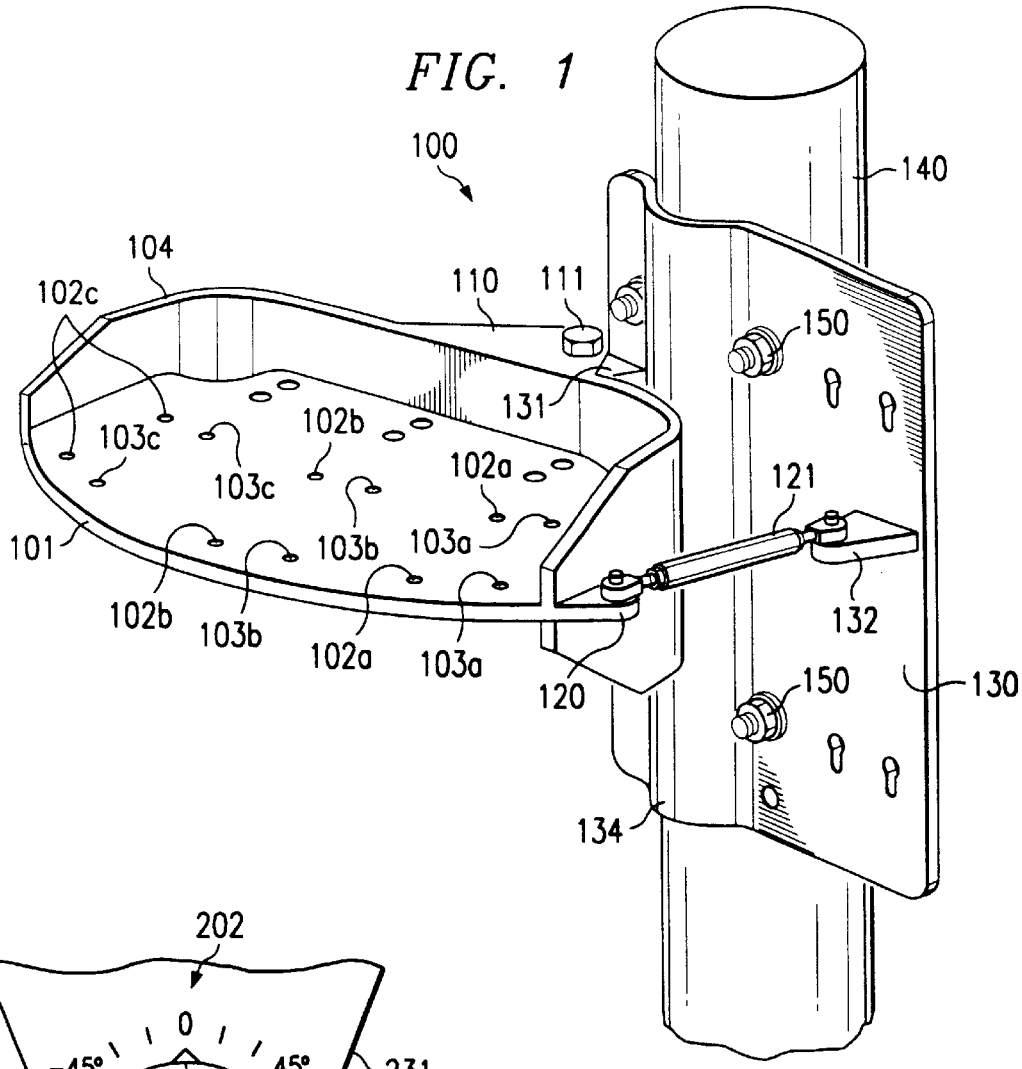
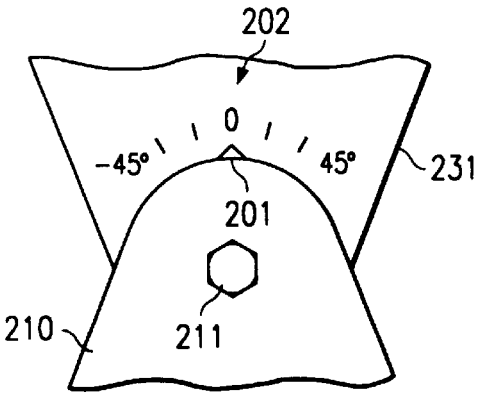
FIG. 2A
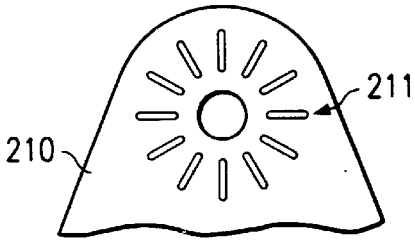
FIG. 2B
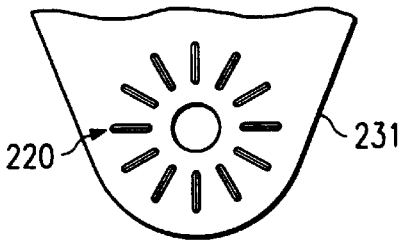
FIG. 2C

FIG. 5A
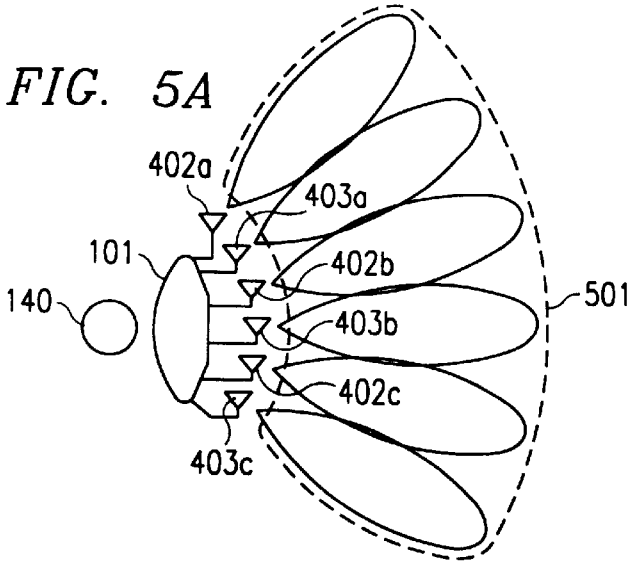
FIG. 5B
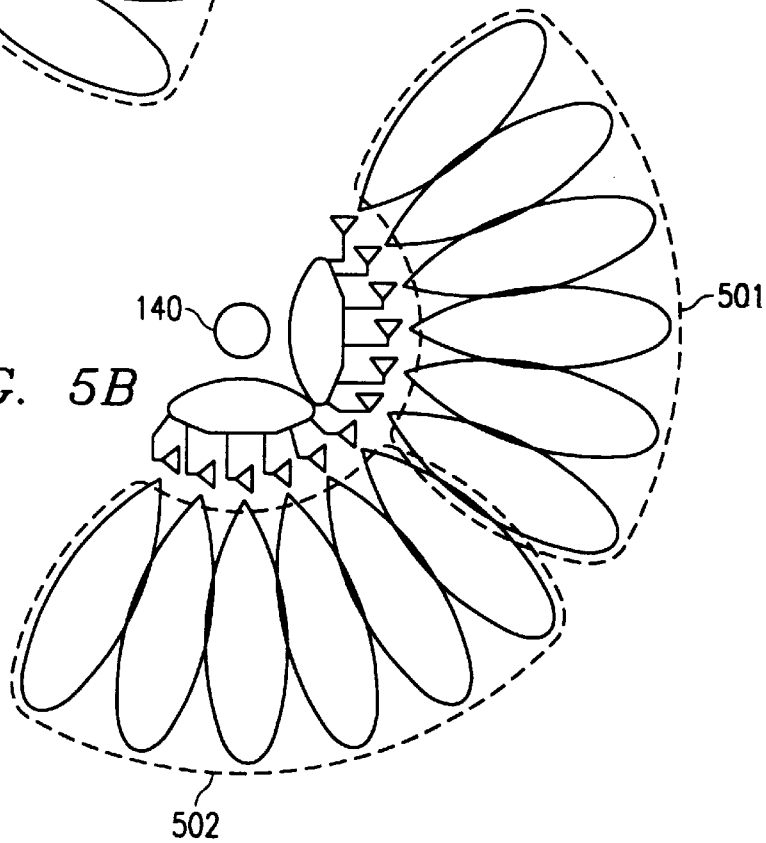
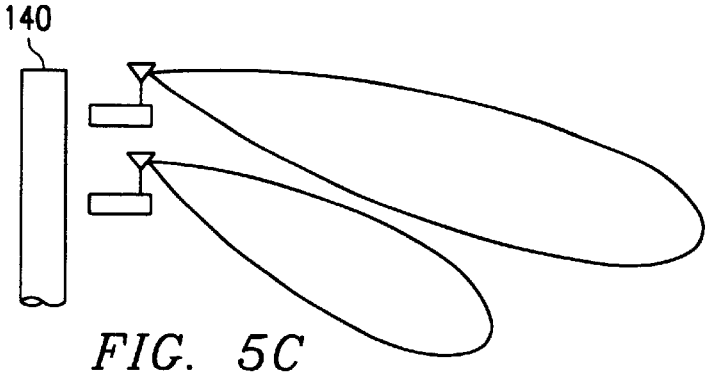
FIG. 5C

ANTENNA FRAME STRUCTURE MOUNTING AND ALIGNMENT

RELATED APPLICATIONS

The present application is related to co-pending and commonly assigned U.S. patent application Ser. No. 08/740,332, entitled "System and Method for Broadband Millimeter Wave Data Communications" filed Nov. 7, 1996, concurrently filed, co-pending and commonly assigned U.S. patent application Ser. No. [47571-P008US-974010], entitled "Millimeter Wave Front End" and concurrently filed, co-pending and commonly assigned U.S. patent application Ser. No. [47571-P010US-986399], entitled "Polarization Plate", the disclosures of which are incorporated herein by reference.

TECHNICAL FIELD

This invention relates generally to the deployment of antennas and more specifically to systems and methods adapted to allow for the modular mounting and adjustment of a plurality of antennas in order to provide desired radiation pattern coverage.

BACKGROUND OF THE INVENTION

It is often desirable to utilize wireless links in order to provide communication of information including voice and data. Accordingly wireless communication infrastructure has been deployed for such communication systems as cellular telephony and point to point microwave data links. However, as the demand for wireless communication increases, the available spectrum, i.e., the frequencies available for wireless communication, must be more wisely utilized.

Accordingly, communication systems have utilized directional antenna arrangements in order to limit the propagation of radio frequency energy to substantially within an area of interest, i.e., providing directional antenna beams in a predetermined pattern to illuminate only a desired geographic area with any particular wireless signal. However, such prior art solutions are typically large arrangements of antennas and support structure and do not lend themselves to simple adjustment of individual antenna beams and/or replacement of antennas. For example, such prior art structures often utilize the antennas themselves, such as broadside panel array antennas, as a portion of the structure in order to provide strength and rigidity without adding weight to the top of a mast. Accordingly, replacement of one such panel often results in the need to re-adjust other ones of the antenna panels. Accordingly, replacement and/or adjustment of any such antenna panel is often very complicated.

Moreover, such solutions relying on the antennas themselves to provide structural support prevent a particular deployment from initially including less than all possible antenna panels, such as when demand for the particular wireless service has not yet developed, and later populating the structure with additional antenna panels as demand increases.

As demand for wireless communication increases, it may be desired to provide additional radiation patterns in which to establish wireless links, i.e., narrower antenna beams to provide additional communication channels or better reuse of channels and/or additional antenna beams, such as overlapping antenna beams, in order to provide more capacity. However, often times the prior art antenna structures are adapted for a particular antenna arrangement or structure and cannot be easily adapted for additional or differently configured antennas. For example, prior art structures generally are not adapted to accept the addition of antennas in order to provide increased capacity.

Accordingly a need in the art exists for a mounting structure which allows the simplified installation, removal, and replacement of antennas associated therewith. A further need exists in the art for the mounting structure to provide for the expansion of communication capacity though the modular addition of communication equipment thereto. A still further need exists in the art for such a mounting structure to be compact in size in order to allow for its deployment in a number of environments, including environments where space and/or weight are limited. A yet further need exists in the art for the mounting structure to be adapted so as to accommodate a variety of commonly available masts or other support structure.

SUMMARY OF THE INVENTION

These and other objects, features and technical advantages are achieved by a system and method which utilizes a base adapted to easily accept communication equipment, such as transceiver equipment and/or their associated antennas, for deployment in a wireless communication system. According to the preferred embodiment of the present invention, the base provides a platform from which antennas may be adjustably and removably deployed in order to provide communications within a selected area. For example, the base of the preferred embodiment may be deployed only partially populated with antenna modules, wherein the antenna beams are directed only at geographic areas currently desirous of wireless communication services. Thereafter, additional antenna modules may be added to the base to service additional wireless subscribers. The addition of antenna modules may include deploying antenna modules such that their beams do not substantially overlap in order to provide wireless communication within an expanded geographic area and/or deploying antenna modules such that their beams substantially overlap in order to provide additional communication capacity within the geographic areas already covered.

The base includes adaptation for mounting to commonly available structure, such as the commonly available 4.5 inch antenna mast. Moreover, in a preferred embodiment of the present invention, adaption of the base for mounting is adjustable in order to accommodate a variety of such commonly available structures. Preferably, the base mounting includes coarse adjustment means to allow a rough selection of the azimuthal orientation of the base to be made and a fine adjustment means to allow the selection of azimuthal orientation to be selected with precision.

Additionally, support structure may be provided for the deployment of electronics associated with the antenna modules utilized according to the present invention. For example, in a preferred embodiment, the aforementioned base mounting includes adaptation to receive associated electronics such as a multiplexer/demultiplexer utilized in reducing the number of cables required to communicate signals up and down the antenna mast.

The preferred embodiment of the present invention includes predefined mounting positions adapted to removably accept the aforementioned antenna modules. Accordingly, both the addition of antenna modules as well as their removal and replacement are simplified as each antenna position is discrete from a next and is in a predetermined and fixed correct azimuth orientation relative to the base. Moreover, the base is preferably adapted to removably accept multiple tiers of antenna modules, i.e., an upper and lower tier of antenna modules, thus allowing a larger number of antenna modules to be deployed in less space azimuthally.

In order to removably accept the antenna modules according to the preferred embodiment, a docking assembly coupling the antenna module to the base is preferably used. In the preferred embodiment, the docking assembly includes coarse adjustment means to allow a rough selection of attitude or elevation of the antenna modules to be made and a fine adjustment means to allow the selection of attitude or elevation to be selected with precision.

The docking assembly of the preferred embodiment is suitable for use in attaching antenna modules in any tier of the base. Accordingly, a single common structure may be utilized for coupling antenna modules to the base of the present invention regardless of their position. Such an adaptation allows for a common spare assembly to be utilized in populating and replacing any antenna module utilized according to the present invention. Moreover, the preferred embodiment of the docking assembly is adapted for use in mounting subscriber antenna modules deployed at the other end of a wireless link associated with the hub. Accordingly, additional economics are realized from the use of the docking assembly.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWING

For a more complete understanding of the present invention, and the advantages thereof, reference is now made to the following descriptions taken in conjunction with the accompanying drawings, in which:

FIG. 1 shows a preferred embodiment of an antenna base according to the present invention;

FIGS. 2A and 2C show a mounting shoulders adapted for simplified coarse azimuthal adjustment and for simplified coarse elevational adjustment depending upon a plane in which they are disposed according to preferred embodiments of the present invention;

FIGS. 5A through 5C show illustrative radiation patterns achievable with the base of FIG. 1.

DESCRIPTION OF THE INVENTION

Figure 3A:
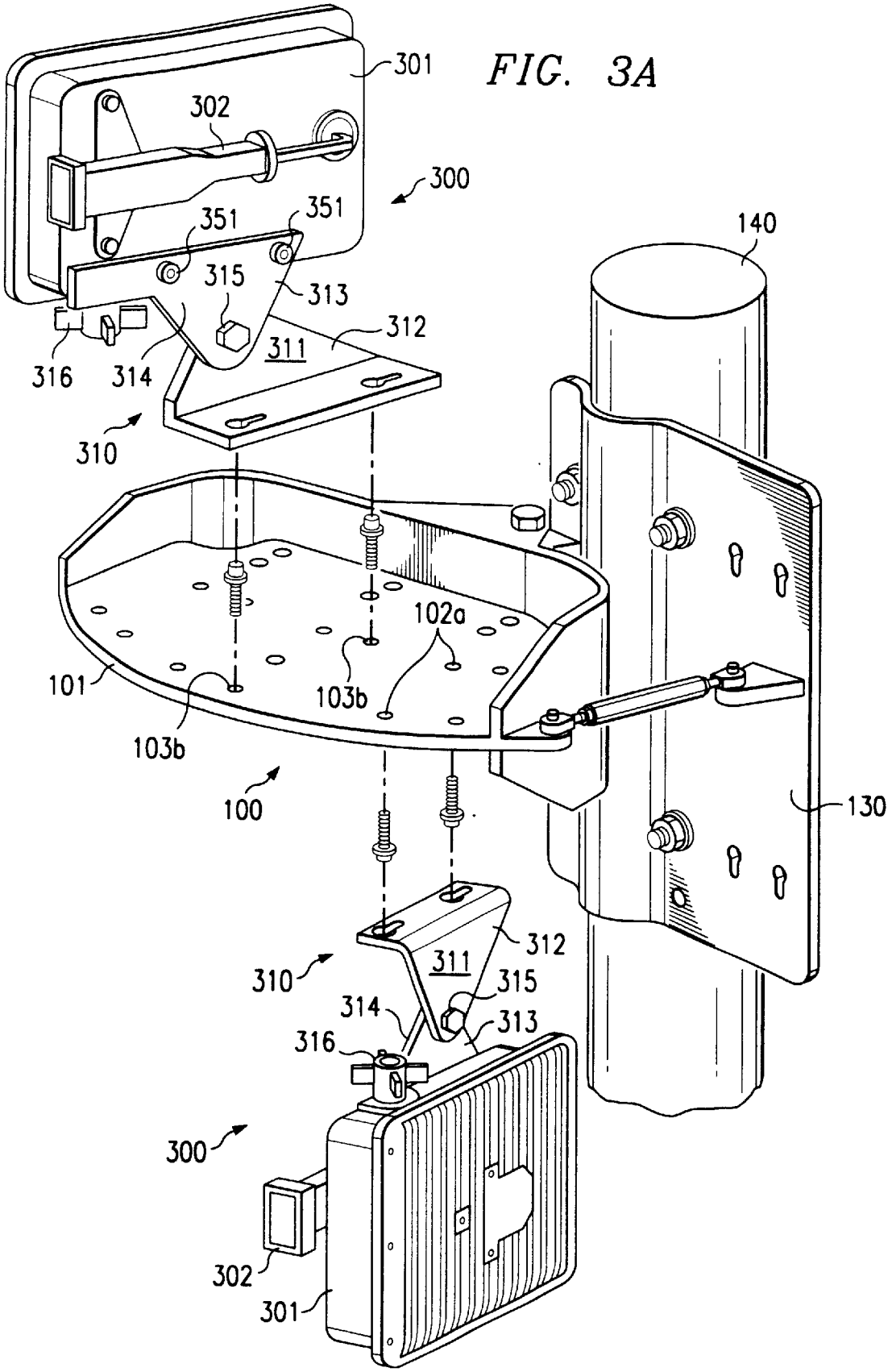
FIG. 3A shows the interfacing of antenna modules to the antenna base of FIG. 1.

Directing attention to FIG. 1, a preferred embodiment of a base adapted according to the present invention is shown generally as base 100. Base 100 includes base plate 101 held to mast 140 by mounting plate 130.

Base plate 101 is adapted to removably accept antenna modules according to the present invention. Accordingly, the preferred embodiment of base plate 101 includes a plurality of sets of mounting holes disposed therein, including mounting hole sets 102*a*–102*c* and 103*a*–103*c*.

It shall be appreciated that each set of mounting holes is positioned in base plate 101 such that coupling of an antenna unit through the use of a mounting hole set positions the antenna module in a selected azimuthal position in relationship to base plate 101. Accordingly, ones of the mounting hole sets may be disposed in base plate 101 such that antenna modules coupled thereby have a different azimuthal orientation than other ones of the antenna modules coupled to base plate 101 by different mounting hole sets. Therefore, antenna modules having directional antenna beams associated therewith, may be deployed to provide substantially non-overlapping antenna beams and thus illuminate a broader area about mast 140.

Likewise, ones of the mounting hole sets may be disposed in base plate 101 such that antenna modules coupled thereby have substantially a same azimuthal orientation as other ones of the antenna modules coupled to base plate 101 by different mounting hole sets. As such, antenna modules may be deployed to provide overlapping antenna beams and thus provide added signal communication within a same area about mast 140.

In the preferred embodiment base plate 101 is adapted to accept multiple tiers of antenna modules. Accordingly, ones of the mounting hole sets, e.g., mounting hole sets 102*a*–102*c*, may be associated with antenna modules of a first tier and other ones of the mounting hole sets, e.g., mounting hole sets 103*a*–103*c*, may be associated with antenna modules of a second tier. It shall be appreciated, by providing multiple tiers of antenna modules, that base 100 of the present invention may occupy less space horizontally in accommodating a desired number of antenna modules, although still being adapted to provide communication within a desired geographic area.

Although described with reference to mounting holes, it shall be appreciated that the coupling of antenna modules to base plate 101 is not so limited. Any number of available mounting apparatus suitable for fixedly holding antenna modules to base plate 101 in a desired orientation may be utilized according to the present invention. For example, pins (not shown) protruding from base plate 101 corresponding to receivers disposed in docling assemblies of the antenna modules may be utilized if desired. Likewise, base plate 101 may include a receiver, such as a slide channel (not shown), adapted to accept a portion of the aforementioned docking assembly.

Mounting plate 130 of the preferred embodiment is adapted to fixedly attach to mast 140, such as through the use of "U" fasteners 150. In order to more securely interface with mast 140, the preferred embodiment of mounting plate 130 includes mast grove 134. Mast grove 134 may include striations, or other surface irregularities, in order to more firmly grip a smooth mast surface, if desired.

Although shown attached to mast 140, it shall be appreciated that the base of the present invention may be coupled to any number of support structures. For example, mounting plate 130 may include a horizontal grove, perpendicular to mast grove 134, in addition to or in the alternative to mast grove in order to couple mounting plate 130 to a horizontal structure. Accordingly, mounting plate may be coupled to a horizontal strut of an antenna tower cross member or a cat walk, such as through the use of "U" fasteners 150 deployed orthogonally to their positioning shown in FIG. 1. Additionally, or alternatively, mounting plate 130 may include various mounting holes, clips, ridges or the like in order to easily attach to a number of structures, such as walls, expanded metal fabrics, roofs, or the like. Moreover, various adaptions of mounting plate 130 may be provided for coupling to base plate 101 depending on a particular support structure to be associated therewith.

Base plate 101 is preferably adjustably coupled to mounting plate 130, such as through use of shoulder 110 of base plate 101 and shoulder 131 of mounting plate 130. Accordingly, by placing shoulder 110 in juxtaposition with shoulder 131 and retaining the shoulders in a desired position, such as through adjustment of fastener 111, base plate 101 may be disposed on a desired position within a range of positions and held firmly once so disposed. For example, although mounting plate 130 may be securely attached to mast 140 with shoulder 131 having a particular azimuthal positioning, base plate 101 may be adjusted azimuthally between a range of positions available with the particular azimuthal position of shoulder 131 and held in a selected azimuthal position by tightening fastener 111, thus providing a desired framing of the antenna modules disposed thereon.

Accordingly, coarse azimuthal adjustment of base plate 101 is readily provided for by base 100 of the preferred embodiment. Moreover, as the mounting hole sets of the preferred embodiment are positioned in base plate 101 such that coupling of an antenna unit through the use of a mounting hole set positions the antenna module in a selected azimuthal position in relationship to base plate 101, coarse azimuthal adjustment of base plate 101 according to the preferred embodiment also provides for coarse adjustment of the antenna modules disposed thereon.

Base plate 101 and/or mounting plate 130 may be adapted to simplify coarse azimuthal adjustment such as by providing graduation markings to assist in determining an amount of azimuthal offset the position of mounting plate 130 and base plate 101 or to provide preselected increments in azimuthal adjustment. For example, directing attention to FIG. 2A, shoulder 110 of base plate 101 and shoulder 131 of mounting plate 130 are shown having graduation markings and associated indicator. Specifically, shoulder 110 includes tine 201 corresponding to graduations 202 of shoulder 131. Accordingly, as base plate 101 is adjusted azimuthally, tine 201 will be directed toward a particular portion of graduations 202 indicating the particular amount of azimuthal offset of base plate 101 with respect to mounting plate 130.

Additionally or alternatively shoulders 110 and 131, corresponding to shoulders 210 and 231 of FIGS. 2B and 2C respectively, may include wards (ridges or notches) 211 and 220, shown in FIGS. 2B and 2C respectively, in their mating surfaces. Wards 211 and 220 may be disposed in shoulders 110 and 131 such that, when shoulders 110 and 131 are placed in juxtaposition with their mating surfaces in communication, wards 211 and 220 interface. Accordingly, by disposing wards 211 and 220 such that their spacing is associated with a desired incremental azimuthal adjustment, a particular amount of azimuthal offset may be selected through stepping base plate 101 through adjustment positions associated with the affirmative interfacing of wards 211 and 220.

Having described the coarse adjustment of base plate 101, and thus the coarse adjustment of antenna modules disposed thereon according to the preferred embodiment of the present invention, it should be appreciated that a more precise adjustment of this azimuthal positioning may often be desired. For example, in a preferred embodiment of the present invention, base 100 is utilized to dispose a plurality of point to multi-point millimeter wave antenna modules at a centralized communication hub as shown in detail in the above referenced patent application entitled "System and Method for Broadband Millimeter Wave Data Communications." Such a system may provide information communication to a plurality of communication nodes or subscriber units, ones of which are in communication with a particular one of the plurality of antenna modules disposed at the communication hub, located miles away from base 100. Accordingly, in order to provide a proper antenna beam for communication with a particular communication node and another such antenna beam for communication with another communication node, it may be necessary to provide precise azimuthal adjustment of base 100.

Therefore, a preferred embodiment of the present invention includes a fine azimuthal adjustment mechanism. Directing attention again to FIG. 1, a preferred embodiment of a fine azimuthal adjustment mechanism is shown including shoulder 120 of base plate 101, shoulder 132 of mounting plate 130, and turnbuckle 121 disposed there between. Accordingly, framing of the antenna modules disposed upon base plate 101 may be adjusted, such as ±10°, by adjusting turnbuckle 121. Therefore, once a coarse azimuthal position of base plate 101 is selected by the aforementioned offset of base plate 101 and mounting plate 130 and adjusting fastener 111, fine azimuthal positioning may be selected by adjusting turnbuckle 121.

Of course, the fine azimuthal adjustment mechanism of the present invention may be embodied in any number of forms in addition to or in the alternative to turnbuckle 121 of FIG. 1, if desired. For example a screw and stopper or screw and pin assembly may be utilized to provide finely adjustable biasing of base plate 101 with respect to mounting plate 130. Likewise, a cam having an eccentric associated therewith may be rotatably coupled to base plate 101 or mounting plate 130 in order to allow fine selection of an offset through rotation of the cam by a follower of mounting plate 130 or base plate 101, respectively engaging the eccentric.

Figure 4A:
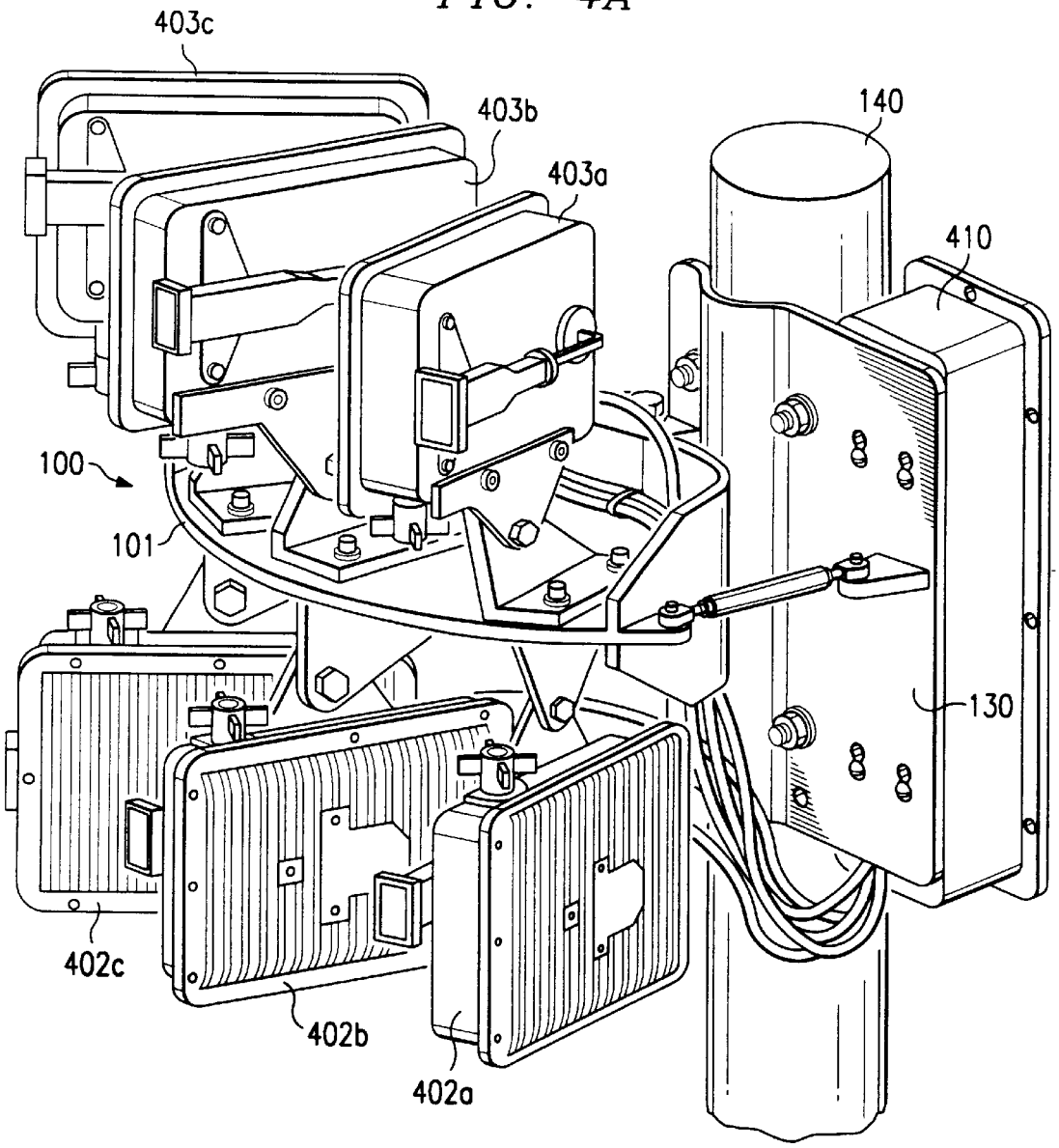
FIGS. 4A and 4B show the antenna base of FIG. 1 fully populated with antenna modules.
Figure 4B:
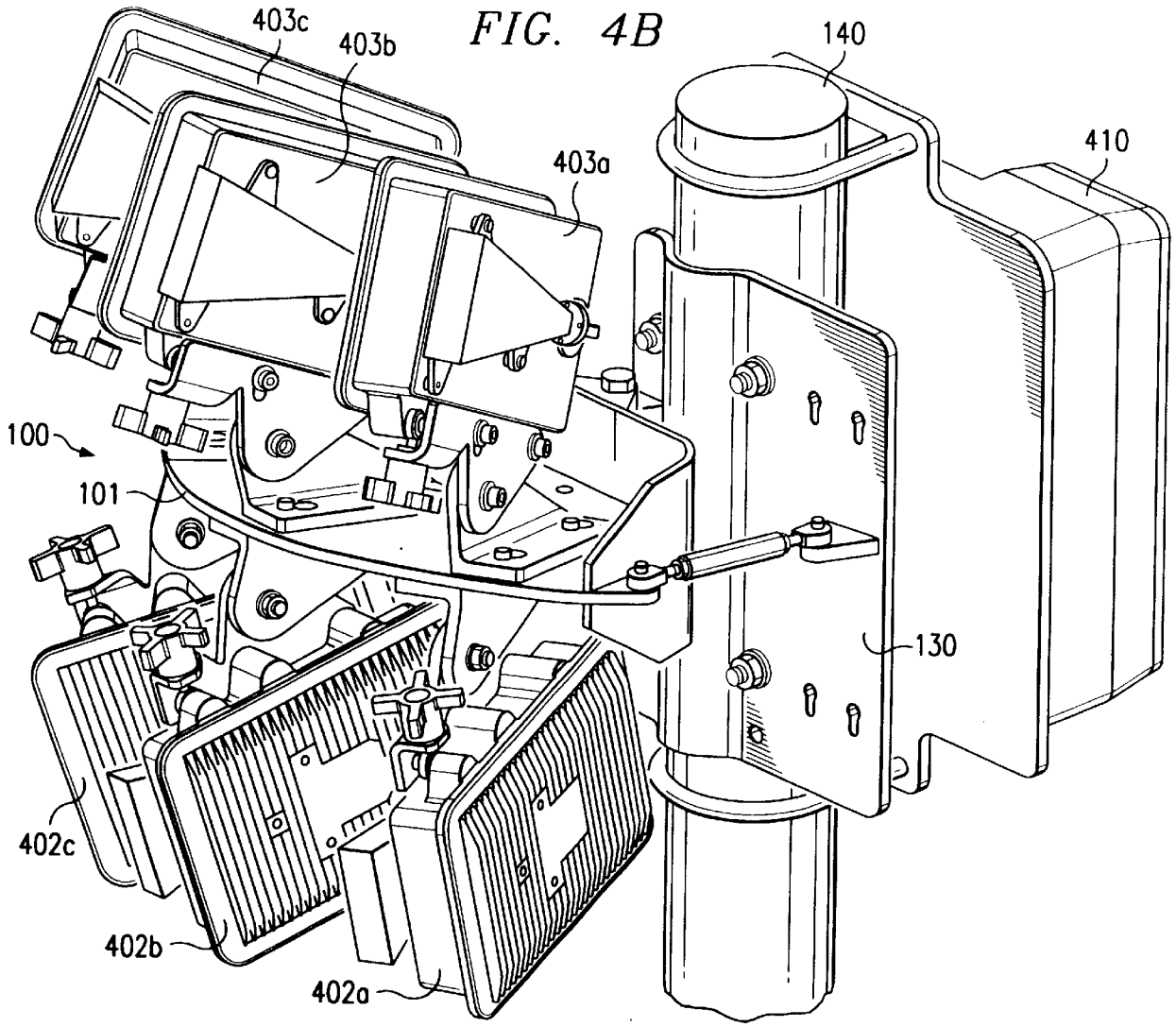

It shall be appreciated that shoulder 120 is disposed at a distal end of base plate 101. Preferably, shoulder 132 is disposed at a position on mounting plate 130 corresponding to the position of shoulder 120 on base plate 101. Accordingly, turnbuckle 121 may be provided with a sufficient amount of leverage to very securely hold a desired relative position of base plate 101, and thus a desired frame of the associated antenna modules, even in the extreme conditions associated with such antenna systems deployment, such as high windage conditions. In the embodiment of mounting plate 130 shown in FIG. 1, the portion of mounting plate 130 associated with disposing shoulder 132 at a position corresponding to the placement of shoulder 120 is adapted to provide additional mounting area. For example, this area of mounting plate 130 may be adapted to receive electronic equipment such as a multiplexer/demultiplexer as shown in FIG. 4A Of course, where such additional mounting area is not desired or where sufficient rigidity of the mounting of base plate 101 to mounting plate 130 is achievable with the fine azimuthal adjustment mechanism of the present invention may be disposed at a location different than shown in FIG. 1, such as at a position more near mast 140. For example, a preferred embodiment of mounting plate 103 does not provide a mounting surface for additional electronics but rather relies upon "U" bolts or other techniques to mount such additional electronics to mast 140 and shown in FIG. 4B.

Base plate 101 may include adaptation in order to provide a more ridged platform upon which to deploy directional antennas. For example, in order to avoid flexing of base plate 101, and thus to provide a very solid base upon which directional antennas which may be utilized to communicate over great distances may be deployed, even in the extreme conditions associated with such antenna systems deployment, base plate 101 may be provided with lip 104 or other structure to provide strength to base plate 101.

Directing attention to FIG. 3A, a preferred embodiment of docking assemblies utilized in interfacing antenna modules, such as antenna modules 300, to base plate 101 are shown generally as docking assemblies 310. Accordingly, antenna modules, which may include a transceiver portion 301, such as is shown in detail in the above referenced patent application entitled "Millimeter Wave Front End," and directional antenna portion 302, which may be coupled to transceiver portion 301 through a polarization adaptor such as shown in detail in the above referenced patent application entitled "Polarization Plate" in order to allow the use of various polarizations with the illustrated equipment, may be deployed to provide communication within desired areas about mast 140.

Antenna modules 300 may be deployed at various positions on base plate 101, corresponding with ones of the mounting hole sets provided therein, in order that each antenna module may have a particular desired azimuthal orientation with respect to base plate 101. For example, as shown in FIG. 3A, antenna modules 300 may be deployed in an upper tier position and a lower tier position. Moreover, antenna modules 300 may be deployed at one of any number of positions associated with either the upper tier or lower tier. However, it should be appreciated that, regardless of the tier and particular tier location at which an antenna module is deployed, the docking assemblies are the same, thus allowing for economies to be realized through their use. Moreover, in the preferred embodiment the transceiver assemblies and antennas so deployed are also the same regardless of the tier and particular tier location at which they are deployed, as is discussed in further detail in the above referenced patent application entitled "Polarization Plate," in order to provide further economy.

In order to provide communications within a desired area, it may be desired to provide a particular antenna with a desired amount of elevational adjustment, i.e., down-tilt or up-tilt. Accordingly, the preferred embodiment of docking assembly 310 includes base 311 adjustably coupled to support 313, such as through use of shoulder 312 of base 311 and shoulder 314 of support 313, to provide elevational adjustment such as by ±30 degrees in elevation from horizontal. Accordingly, by placing shoulder 312 in juxtaposition with shoulder 314 and retaining the shoulders in a desired position, such as through adjustment of fastener 315, docking assembly 310 may be adjusted to a desired position within a range of positions and held firmly once adjusted. For example, although base plate 101 may provide a platform substantially parallel to a surface to be illuminated by the radiation patterns of an antenna disposed thereon, an end of antenna module 301 may be adjusted elevationally between a range of positions and held in a selected elevation orientation by tightening fastener 315. Accordingly, coarse elevational adjustment of antenna module 300 is readily provided for by docking assembly 310 of the preferred embodiment.

Base 311 and/or support 313 may be adapted to simplify coarse elevation adjustment as is described above with respect to coarse adjustment of the offset of base plate 101. For example, shoulders 312 and 314 may be adapted as shoulders 210 and 231 shown in FIG. 2. Accordingly, shoulder 312 of base 311 and shoulder 314 of support 313 may include graduation markings and associated indicator. Therefore, as support 313 is adjusted elevationally, a tine may be directed toward a particular portion of the graduations, thus indicating the particular amount of elevation adjustment associated with the docking assembly.

Additionally or alternatively shoulders 312 and 314 may include wards (ridges or notches) in their mating surfaces, such as those shown for shoulders 210 and 231 of FIGS. 2B and 2C. These wards may be disposed in shoulders 312 and 314 such that, when shoulders 312 and 314 are placed in juxtaposition with their mating surfaces in communication, the wards interface. Accordingly, by disposing the wards such that their spacing is associated with a desired incremental elevation adjustment, a particular amount of elevation adjustment may be selected through stepping support 313 through adjustment positions associated with the affirmative interfacing of the wards. A preferred embodiment of wards utilized with shoulders 312 and 314 provide for incremental elevation adjustment of 5°.

Having described the coarse adjustment of docking assembly, and thus the coarse adjustment of an antenna module disposed thereon according to the preferred embodiment of the present invention, it should be appreciated that a more precise adjustment of this elevation positioning may often be desired. For example, in order to provide a proper antenna beam for communication with a particular communication node, it may be necessary to provide precise elevation adjustment of docking assembly 310.

Figure 3B:
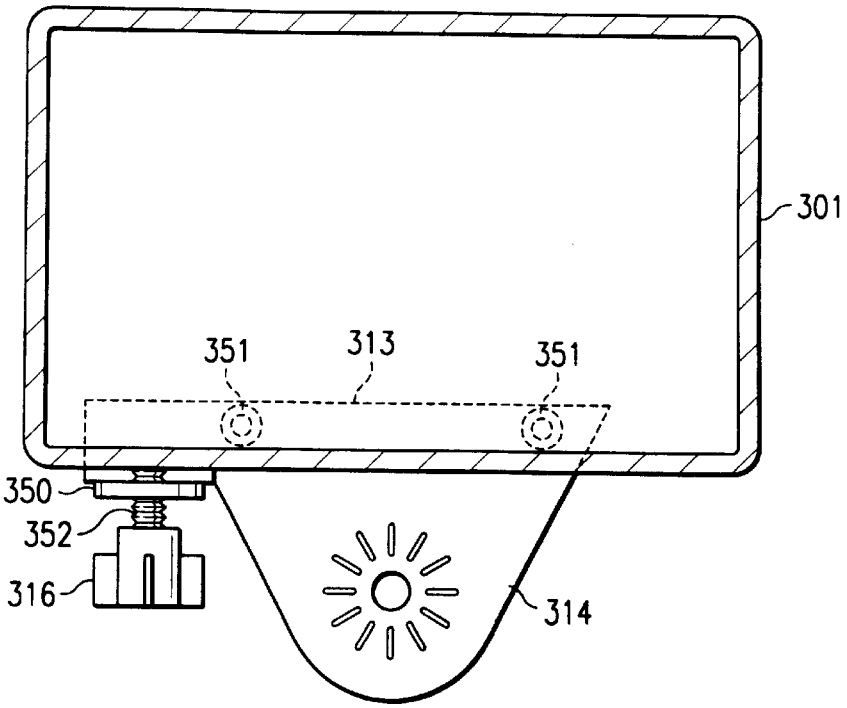
FIGS. 3B and 3C show a portion of a docking assembly having alternative embodiments of fine adjustment mechanics thereon.

Accordingly, a preferred embodiment of the present invention includes a fine elevation adjustment mechanism. Directing attention to again to FIG. 3A, a preferred embodiment of a fine elevation adjustment mechanism is shown as a screw and stopper assembly including screw 316. This assembly is shown in more detail in FIG. 3B. As shown in the embodiment of FIG. 3B, a threaded portion 352 of screw 316 is threaded through retainer 350 of support 313 such that a distal end of screw 316 abuts a surface of transceiver 301 to provide for elevation adjustment of the antenna module, such as by as much as several degrees, by turning screw 316. Therefore, once a coarse elevation orientation of antenna module 300 is selected, by loosening screws 351 and adjusting fastener 315, fine elevation positioning may be selected by adjusting screw 316.

Of course, as with the fine azimuthal adjustment mechanism discussed above, the fine elevation adjustment mechanism of the present invention may be embodied in any number of forms in addition to or in the alternative to the screw and stopper assembly of FIG. 3, if desired. For example a turnbuckle assembly may be utilized to provide finely adjustable biasing of antenna module 300. Likewise, a cam having an eccentric associated therewith may be rotatably coupled to base 311 or support 313 in order to allow fine selection of an elevation offset through rotation of the cam.

Figure 3C:
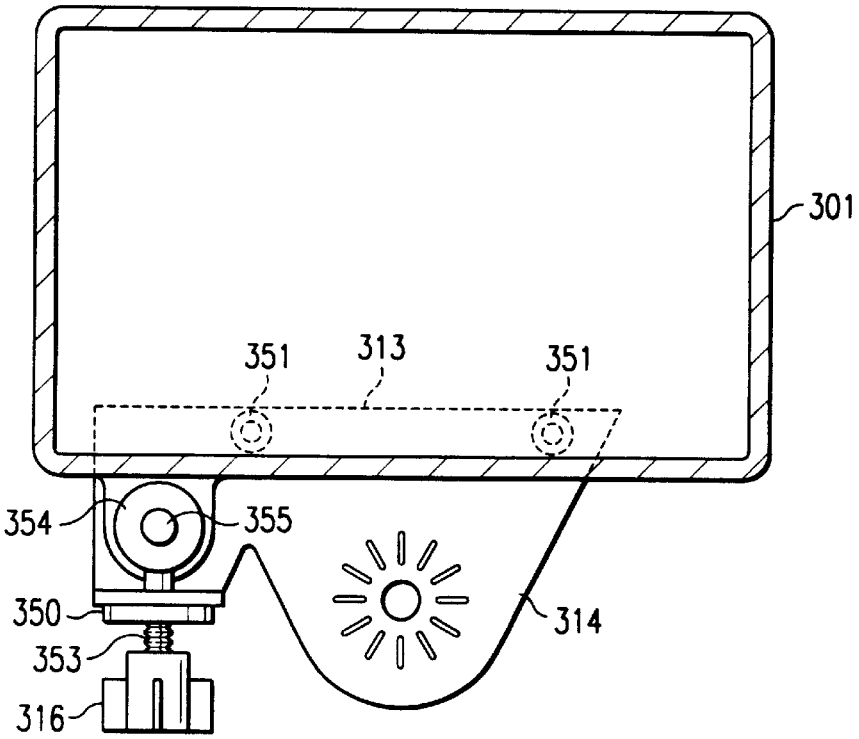

One such alternative embodiment is shown in FIG. 3C wherein screw 316 is adapted to include engagement ring 354. Accordingly, threaded portion 352 of screw 316 may be threaded through retainer 350 of support 313 while engagement ring 354 engagement pin 355 affixed to transcriber 301. Although a detent is shown in transcriber 301 to receive engagement ring 354 and to hold pin 355, no such adaptation of transcriber 301 is necessary according to the present invention. For example, pin 355 may be a "J" or a "U" shaped pin or otherwise adapted to extend below a bottom surface of transceiver 301 and engage engagement ring 354, if desired.

Preferably, docking assembly 310 is adapted for easy coupling and decoupling of antenna modules to base 100 in order to allow for simplified deployment and/or replacement of antenna modules once deployed. Accordingly, the preferred embodiment shown in FIG. 3A includes key slots corresponding to the placement of the mounting holes of mounting hole sets. This arrangement allows fasteners, such as screws, to be disposed in particular ones on the mounting hole sets and to accept or release the docking assembly, and thus the antenna module, without requiring removal of the fasteners. Of course, as mentioned above, the present invention is not limited to the use of mounting hole sets and, therefore, corresponding fasteners. For example, base 311 may include flanges (not shown) corresponding to a slide channel disposed on base plate 101, adapted to slidably accept the aforementioned docking assembly.

The preferred embodiment of docking assembly 310 is also useful for mounting subscriber unit transceivers and their adjustment to provide a wireless link with a hub antenna. Accordingly, a plate assembly adapted to accept a single subscriber unit transceiver may be used with docking assembly 310 and a subscriber transceiver unit. Additionally, or alternatively, a mounting plate adapted to fasten to structure, such as poles, horizontal members, roofs, walls, or even desktops or window stools may be coupled to docking assembly for use at a subscriber site.

It shall be appreciated that, although a preferred embodiment of the present invention is adapted such that each individual antenna module may be separately adjusted elevationally, alternative embodiments adapted to provide for the elevational adjustment of multiple ones of the antenna modules may be utilized according to the present invention. For example, an alternative embodiment of the present invention includes adaptation for elevationally adjusting, i.e., tilting, of base plate 101 to provide for simultaneous elevation adjustment of all antenna modules disposed thereon. Accordingly, an elevational adjustment mechanism, such as the aforementioned shoulders 312 and 314, may be disposed between base plate 101 and mounting plate 130 to allow for its tilting from horizontal in addition to or in the alternative to the azimuthal adjustment described above. Additionally or alternatively, the docking assembly of the present invention may be adapted to couple to a plurality of transceivers and/or antennas, such as to allow multiple transceivers, each having a particular communication channel, polarization, radiation pattern, or the like associated therewith, to be simultaneously adjusted elevationally.

However, it shall be appreciated that individual adjustment of the antenna modules, as described with respect to the preferred embodiment above, may be desired. For example, where the antenna modules, having a different azimuthal orientation, are utilized to provide substantially non-overlapping radiation patterns to illuminate a desired geographic area, simultaneous adjusting multiple ones of the modules by adjusting a common base (either base plate or docking assembly) may cause undesired results in the radiation patterns. Specifically, where a base plate is tilted which is associated with antenna modules providing six non-overlapping 16° antenna beams resulting in approximately a 90° field of view, beams associated with antenna modules disposed more near the middle of the base plate, those substantially co-axial with the elevation adjustment mechanism, will be foreshortened with respect to beams associated with antenna modules disposed more near the outer edges of the base plate, those less co-axial with the elevation adjustment mechanism.

Likewise, it shall be appreciated that, although a preferred embodiment of the present invention is adapted such that all antenna modules are simultaneously adjusted azimuthally, alternative embodiments adapted to provide separated adjustment of ones of the antenna modules may be utilized according to the present invention. For example, an alternative embodiment may include arced portions of a key slot of the docking assembly in order to allow the lateral movement of at least one end thereof and, thus, adjustment of the azimuthal orientation of the associated antenna module. Similarly, shoulders adapted for azimuthal adjustment, similar to those described above with respect to base plate 101 and mounting plate 130, may be provided on docking assembly 310 to allow for the azimuthal adjustment of antenna modules associated therewith.

Directing attention to FIG. 4A, the preferred embodiment base 100 of FIG. 1 is shown fully populated with antenna modules 402*a*–402*c* of the lower tier, removably coupled utilizing mounting hole sets 102*a*–102*c* respectively, and antenna modules 403*a*–403*c* of the upper tier, removably coupled utilizing mounting hole sets 103*a*–103*c*. Also shown is multiplexer 401 coupled to mounting plate 130 providing manipulation of communication signals in addition to that of antenna modules 402*a*–402*c* and 403*a*–403*c*.

Where each of the antenna modules of FIG. 4A provide a 16° antenna beam and mounting hole sets 102*a*–102*c* and 103*a*–103*c* are disposed so as to provide approximately 15° between antenna beams, an approximately 90° composite radiation pattern is formed from the six substantially non-overlapping antenna beams. This radiation pattern is illustrated as composite pattern 501 in FIG. 5A.

Moreover, by disposing multiple ones of base 100 about mast 140 additional geographic areas may be provided with communication. For example, two bases 100 may be deployed such that 180° of coverage is provided such as by composite pattern 501 associated with a first fully populated base of the present invention and composite pattern 502 associated with a second fully populated base of the present invention as shown in FIG. 5B. Additionally, or alternatively, additional coverage may be provided by provided such as by adjusting antenna modules elevationally. For example, FIG. 5C shows two bases of the present invention wherein antenna modules of each base are adjusted to provide a different outboard reach from mast 140.

Of course, although discussed above with respect to antenna modules of different bases, it shall be appreciated that the antenna modules of a single base may be adjusted to provide coverage other than the above described substantially non-overlapping coverage. For example, antenna modules having approximately 30° antenna beams associated therewith may be adjusted to provide the 90° azimuthal concentric coverage of FIG. 5C. Specifically, the antennas of the upper tier of base 100 may be elevationally adjusted to provide a greater outboard reach than the antennas of the lower tier of base 100.

It shall be appreciated that although the above examples have been described with respect to a fully populated base providing 90° of coverage, there is no such limitation to the present invention. For example, where the aforementioned 16° antenna beams are desired, concentric radiation patterns may be formed as described above wherein each composite concentric radiation pattern is approximately 45° through proper orientation of mounting hole sets 102*a*–102*c* and 103*a*–103*c*.

Likewise, the base plate of the present invention is not limited to receiving six antenna modules. Depending upon the size of the antenna modules and the size of the desired base plate, a base according to the present invention may be provided which accepts any desired number of antenna modules and in any relationship to the other antenna modules.

Of course, the base of the present invention is not limited to the two tiers of antenna modules described and, therefore, is fully scalable and may include any number of tiers desired. For example, a single tier of antenna modules may be used to provide communication, such as where deployment of the antenna modules utilized would not benefit from reduced horizontal space utilization. Similarly, more than two tiers may be provided in a base, such as by coupling multiple base plates to a single mounting plate, such as to provide increased capacity associated with overlapping antenna beams of ones of the tiers.

It shall be appreciated that the base of the present invention provides a platform which may be deployed only partially populated, in order to serve a present demand for wireless communication services. Subsequently the base may be populated with antenna modules as needed to serve growing demand for wireless communication services. Accordingly, the present invention provides an economical system and method for deploying a wireless communication system, such as a point to multi-point system. Moreover, as the base of the present invention is itself modular, structure sufficient to deploy an ultimately desired number of antenna modules may be deployed in phases. For example, a first partially populated base may be deployed to service an immediate need. Thereafter, as wireless communications are desired in an area outside the area of coverage associated with the first base, a second partially populated base may be deployed. Subsequently each of these bases may be fully populated as capacity so demands. Thereafter, additional increases in capacity may be served through deploying additional bases having an overlapping field of view with the first and/or second bases.

As the antenna modules are modular, the present invention provides for simplified servicing. Specifically, a damaged or malfunctioning antenna module may be easily and quickly replaced with a standard component as needed.

Although the present invention and its advantages have been described in detail, it should be understood that various changes, substitutions and alterations can be made herein without departing from the spirit and scope of the invention as defined by the appended claims.

What is claimed is:

1. A system for providing modular deployment of wireless communication equipment, wherein said communication equipment provides directional wireless communication within a predefined area, said system comprising:

at least one base assembly adapted to removably retain a selected number of wireless communication transducers in predetermined orientations to provide said directional wireless communication within said predefined area, wherein said base assembly may be populated with a number of wireless communication transducers less than said selected number and subsequently populated with additional numbers of wireless communication transducers up to said selected number, and wherein said base assembly is adapted to provide adjustment of coupled ones of said wireless communication transducers in both a horizontal and vertical plane.

2. The system of claim 1, wherein said base assembly comprises:

a docking assembly having a first portion disposed to couple to apparatus associated with at least one said wireless communication transducer, wherein said docking assembly includes an adjustment mechanism providing at least a portion of said adjustment in said vertical plane.

3. The system of claim 2, wherein said adjustment mechanism is a friction coupling allowing said first portion of said docking assembly to be rotatably adjusted with respect to a second portion of said docking assembly.

4. The system of claim 2, wherein said adjustment mechanism is a mechanism disposed between said first portion of said docking assembly and said apparatus associated with at least one said wireless communication transducer.

5. The system of claim 2, wherein said adjustment mechanism provides both coarse and fine adjustment in said vertical plane.

6. The system of claim 5, wherein said coarse adjustment is provided by a first portion of said adjustment mechanism and said fine adjustment is provided by a second portion of said adjustment mechanism.

7. The system of claim 6, wherein said first portion of said adjustment mechanism comprises:

a friction coupling allowing said first portion of said docking assembly to be rotatably adjusted with respect to a second portion of said docking assembly.

8. The system of claim 6, wherein said second portion of said adjustment mechanism comprises:

a screw assembly disposed between said first portion of said docking assembly and said apparatus associated with at least one said wireless communication transducer.

9. The system of claim 2, wherein said docking assembly further includes an adjustment mechanism providing at least a portion of said adjustment in said horizontal plane.

10. The system of claim 9, wherein said horizontal plane adjustment includes a slidable mount allowing horizontal travel of at least a portion of said docking assembly.

11. The system of claim 1, wherein said base assembly comprises:

a support assembly having a first portion disposed to couple to said selected number of wireless communication transducers and a second portion disposed to couple to a host structure, wherein said support assembly includes an adjustment mechanism providing at least a portion of said adjustment in said horizontal plane.

12. The system of claim 11, wherein said adjustment mechanism is a friction coupling allowing said first portion of said support assembly to be rotatably adjusted with respect to said second portion of said support assembly.

13. The system of claim 11, wherein said adjustment mechanism provides both coarse and fine adjustment in said horizontal plane.

14. The system of claim 13, wherein said coarse adjustment is provided by a first portion of said adjustment mechanism and said fine adjustment is provided by a second portion of said adjustment mechanism.

15. The system of claim 14, wherein said first portion of said adjustment mechanism comprises:

a friction coupling allowing said first portion of said support assembly to be rotatably adjusted with respect to said second portion of said support assembly.

16. The system of claim 14, wherein said second portion of said adjustment mechanism comprises:

a turnbuckle assembly disposed between said first portion of said support assembly and said second portion of said support assembly.

17. The system of claim 11, wherein said support assembly comprises:

a first sub-division of said first portion disposed to couple to a subset of said selected number of wireless communication transducers; and a second sub-division of said first portion disposed to couple to a different subset of said selected number of wireless communication transducers.

18. The system of claim 17, wherein said first sub-division and said second sub-division are disposed on different surfaces of said first portion, wherein said selected number of wireless communication transducers may be removably coupled to said support assembly in a reduced amount of space.

19. The system of claim 11, wherein said second portion of said support assembly comprises:

a surface adapted to accept communication equipment associated with coupled ones of said wireless communication transducers.

20. The system of claim 11, wherein said second portion of said support assembly is adapted to couple to a plurality of different sized host structures.

21. The system of claim 1, further comprising:

a second base assembly adapted to removably retain a selected number of wireless communication transducers in predetermined orientations to provide said directional wireless communication within said predefined area, wherein said base assembly may be populated with a number of wireless communication transducers less than said selected number and subsequently populated with additional numbers of wireless communication transducers up to said selected number, and wherein said base assembly is adapted to provide adjustment of coupled ones of said wireless communication transducers in both a horizontal and vertical plane.

22. The system of claim 21, wherein said at least one base assembly is adapted to provide directional wireless communication within a first portion of said predefined area and said second base assembly is adapted to provide directional wireless communication within a second portion of said predefined area.

23. The system of claim 21, wherein said at least one base assembly and said second base assembly are adapted to provide directional wireless communication within substantially a same portion of said predefined area.

24. An antenna frame structure comprising:

a mounting plate adapted to fixedly attach to a support structure;

a base plate adjustably coupled to said mounting plate, wherein said base plate is adapted to removably receive a plurality of antenna modules at preselected positions on said base plate; and at least one docking apparatus adapted to removably interface with said base plate at any of said preselected positions, wherein said docking apparatus is adapted to adjustably couple at least one antenna module of said antenna modules to said base plate.

25. The antenna frame structure of claim 24, wherein said mounting plate is adapted to removably receive communication equipment associated with said antenna modules.

26. The antenna frame structure of claim 24, wherein said adaptation of said mounting plate to fixedly attach to a support structure comprises a detent to substantially conform to said support structure.

27. The antenna frame structure of claim 26, wherein said detent is adapted to substantially conform to a plurality of different sized support structures.

28. The antenna frame structure of claim 24, further comprising:

a first adjustable coupler disposed between said mounting plate and said base plate providing said adjustable coupling of said base plate to said mounting plate.

29. The antenna frame structure of claim 28, wherein said first adjustable coupler comprises a shoulder portion of said base plate placed in juxtaposition with a shoulder portion of said mounting plate.

30. The antenna frame structure of claim 28, wherein said first adjustable coupler provides coarse azimuthal offset adjustment of said base plate with respect to said mounting plate.

31. The antenna frame structure of claim 30, wherein said first adjustable coupler is adapted to provide an indication of a particular amount of coarse azimuthal offset of said base plate with respect to said mounting plate.

32. The antenna frame structure of claim 30, wherein said first adjustable coupler is adapted to provide incremental adjustment of said coarse azimuthal offset of said base plate with respect to said mounting plate.

33. The antenna frame structure of claim 30, further comprising:

a second adjustable coupler disposed between said mounting plate and said base plate providing fine azimuthal offset adjustment of said base plate with respect to said mounting plate.

34. The antenna frame structure of claim 33, wherein said second adjustable coupler is a turnbuckle.

35. The antenna frame structure of claim 33, wherein said second adjustable coupler is a screw stop assembly.

36. The antenna frame structure of claim 24, wherein said preselected positions comprise a plurality of positions adapted to provide at least a 90° field of view when fully populated with said plurality of antenna modules.

37. The antenna frame structure of claim 36, wherein said at least 90° field of view is provided by at least six preselected positions when said antenna modules of said plurality of antenna modules provide approximately a 16° azimuthal antenna beam.

38. The antenna frame structure of claim 24, wherein ones of said preselected positions are associated with a first tier of said base plate and other ones of said preselected positions are associated with a second tier of said base plate.

39. The antenna frame structure of claim 38, wherein antenna modules coupled to said base plate at positions associated with said first tier provide antenna beam patterns substantially non-overlapping with antenna beam patterns provided by antenna modules coupled to said base plate at positions associated with said second tier.

40. The antenna frame structure of claim 39, wherein said substantially non-overlapping antenna beam patterns of said first and second tier are interleaved.

41. The antenna frame structure of claim 39, wherein said substantially non-overlapping antenna beam patterns of said first and second tier provide overlaying radiation patterns.

42. The antenna frame structure of claim 38, wherein antenna modules coupled to said base plate at positions associated with said first tier provide antenna beam patterns substantially overlapping antenna beam patterns.

43. The antenna frame structure of claim 24, wherein said at least one docking apparatus comprises:

a base adapted to removably couple to said base plate; and a support adjustably coupled to said base, wherein said support is adapted to receive said at least one antenna module.

44. The antenna frame structure of claim 43, further comprising:

a first adjustable coupler disposed between said base and said support providing said adjustable coupling of said base to said support.

45. The antenna frame structure of claim 44, wherein said first adjustable coupler comprises a shoulder portion of said base placed in juxtaposition with a shoulder portion of said support.

46. The antenna frame structure of claim 44, wherein said first adjustable coupler provides coarse elevational adjustment of an antenna module coupled to said support.

47. The antenna frame structure of claim 46, wherein said first adjustable coupler is adapted to provide an indication of a particular amount of coarse elevational adjustment.

48. The antenna frame structure of claim 46, wherein said first adjustable coupler is adapted to provide incremental adjustment of said coarse elevational adjustment.

49. The antenna frame structure of claim 46, further comprising:

a second adjustable coupler disposed between said support and said at least one antenna module providing fine elevational adjustment of said at least one antenna module.

50. The antenna frame structure of claim 49, wherein said second adjustable coupler is a screw stop assembly.

51. The antenna frame structure of claim 24, wherein said at least one antenna module is an antenna structure.

52. The antenna frame structure of claim 24, wherein said at least one antenna module is an integrated antenna structure and transceiver component.

53. A method for deploying wireless communication equipment, wherein said communication equipment provides adjustable directional wireless communication within an area, said method comprising the steps of:

fixedly attaching a mounting plate to a support structure;

adjusting a base plate coupled to said mounting plate to provide a desired azimuthal orientation of said base plate, wherein said base plate includes a plurality of antenna module receiving positions each of which are disposed upon said base plate with a particular azimuthal orientation with respect to said base plate;

coupling at least one antenna module to a docking apparatus, wherein said docking apparatus is adapted to adjustably couple said least one antenna module to said base plate at any one of said base plate receiving positions;

removably coupling said docking apparatus to a said base plate at a selected one of said base plate receiving positions to provide communication within a selected portion of said area; and adjusting said docking apparatus to provide a desired elevational orientation of said antenna module consistent with providing communication within said selected portion of said area.

54. The method of claim 53, wherein said base plate adjusting step comprises the steps of:

adjusting a first adjustable coupler providing coarse azimuthal offset adjustment of said base plate with respect to said mounting plate; and adjusting a second adjustable coupler providing fine azimuthal offset adjustment of said base plate with respect to said mounting plate.

55. The method of claim 53, wherein said docking apparatus adjusting step comprises the steps of:

adjusting a first adjustable coupler providing coarse elevational adjustment of said antenna module coupled to said docking apparatus; and adjusting a second adjustable coupler providing fine elevational adjustment of said antenna module.

56. The method of claim 53, further comprising the step of:

populating said base plate with additional antenna modules as demand for wireless communication services increase within said area, wherein said populating step comprises the steps of:

coupling another at least one antenna module to another said docking apparatus; and removably coupling said another docking apparatus to a said base plate at another selected one of said base plate receiving positions to provide communication within another selected portion of said area.

57. A system for deploying wireless communication equipment, wherein said communication equipment provides adjustable directional wireless communication within an area, said system comprising:

means for fixedly attaching a mounting plate to a support structure;

means for coupling a base plate to said mounting plate, wherein said base plate includes a plurality of antenna module receiving positions each of which are disposed upon said base plate with a particular azimuthal orientation with respect to said base plate;

means for adjusting said base plate coupled to said mounting plate to provide a desired azimuthal orientation of said base plate;

means for coupling at least one antenna module to a docking apparatus, wherein said docking apparatus is adapted to adjustably couple said least one antenna module to said base plate at any one of said base plate receiving positions;

means for removably coupling said docking apparatus to a said base plate at a selected one of said base plate receiving positions to provide communication within a selected portion of said area; and means for adjusting said docking apparatus to provide a desired elevational orientation of said antenna module consistent with providing communication within said selected portion of said area.

58. The system of claim 57, wherein said base plate comprises:

means for providing coarse azimuthal offset adjustment of said base plate with respect to said mounting plate; and means for providing fine azimuthal offset adjustment of said base plate with respect to said mounting plate.

59. The system of claim 57, wherein said docking apparatus comprises:

means for providing coarse elevational adjustment of said antenna module coupled to said docking apparatus; and means for providing fine elevational adjustment of said antenna module.

60. The system of claim 57, further comprising:

means for populating said base plate with additional antenna modules as demand for wireless communication services increase within said area.

61. The system of claim 60, wherein said populating means comprises:

means for coupling another at least one antenna module to another said docking apparatus; and means for removably coupling said another docking apparatus to a said base plate at another selected one of said base plate receiving positions to provide communication within another selected portion of said area.

62. A system for deploying antenna structure comprising:

a mounting plate adapted to fixedly attach to a plurality of different support structures;

a base plate adjustably coupled to said mounting plate, wherein said base plate is adapted to removably receive a plurality of antenna modules at preselected positions on said base plate;

at least one docking apparatus adapted to removably interface with said base plate at any of said preselected positions, wherein said docking apparatus is adapted to adjustably couple at least one antenna module of said antenna modules to said base plate;

a first adjustable coupler providing coarse azimuthal offset adjustment of said base plate with respect to said mounting plate disposed between said mounting plate and said base plate providing said adjustable coupling of said base plate to said mounting plate; and a second adjustable coupler disposed between said mounting plate and said base plate providing fine azimuthal offset adjustment of said base plate with respect to said mounting plate.

63. The system of claim 62, wherein said mounting plate is adapted to removably receive communication equipment associated with said antenna modules.

64. The system of claim 62, wherein said first adjustable coupler comprises a shoulder portion of said base plate placed in juxtaposition with a shoulder portion of said mounting plate.

65. The system of claim 62, wherein said second adjustable coupler is a turnbuckle.

66. The system of claim 62, wherein said preselected positions comprise six positions adapted to provide approximately a 90° composite antenna beam pattern when fully populated with said plurality of antenna modules when said antenna modules provide approximately a 16° azimuthal antenna beam.

67. The system of claim 66, wherein three of said preselected positions are associated with a first tier of said base plate and the other three of said preselected positions are associated with a second tier of said base plate.

68. The system of claim 62, wherein said at least one docking apparatus comprises:

a base adapted to removably couple to said base plate;

a support adjustably coupled to said base, wherein said support is adapted to receive said at least one antenna module;

a first adjustable coupler providing coarse elevational adjustment of an antenna module coupled to said support disposed between said base and said support providing said adjustable coupling of said base to said support; and a second adjustable coupler disposed between said support and said at least one antenna module providing fine elevational adjustment of an antenna module coupled to said support.

* * * * *